United States Patent [19]

Johnson

[11] Patent Number: 4,480,656

[45] Date of Patent: Nov. 6, 1984

[54] PLUMBING FIXTURE

[76] Inventor: Robert L. Johnson, 655 S. Dakota St., Seattle, Wash. 98108

[21] Appl. No.: 13,147

[22] Filed: Feb. 21, 1979

Related U.S. Application Data

[63] Continuation-in-part of Ser. No. 798,836, May 20, 1977.

[51] Int. Cl.[3] ..... F16K 24/00

[52] U.S. Cl. ..... 137/215; 137/216; 4/211; 68/DIG. 2; 134/186

[58] Field of Search ..... 137/215, 216, 216.1; 4/211; 68/DIG. 2; 134/186, 103

[56] References Cited

U.S. PATENT DOCUMENTS

| | | | |
|---|---|---|---|
| 1,201,081 | 10/1916 | Nilson | 4/211 |
| 2,575,905 | 11/1951 | Boosey | 137/216 |
| 2,691,986 | 10/1954 | Kirby | 137/216 |
| 2,755,652 | 7/1956 | Shelton et al. | 68/DIG. 2 |
| 2,878,826 | 3/1959 | Dolenga | 137/216 |
| 3,086,543 | 4/1963 | McAuley | 137/216 |
| 3,346,887 | 10/1967 | Sommer | 4/211 |
| 3,894,302 | 7/1975 | Lasater | 4/211 |
| 3,968,815 | 7/1976 | Leggnee Jouve et al. | 4/211 |

FOREIGN PATENT DOCUMENTS

| | | | |
|---|---|---|---|
| 184238 | 5/1936 | Fed. Rep. of Germany | 137/216 |

*Primary Examiner*—A. Michael Chambers

*Attorney, Agent, or Firm*—Thomas W. Secrest

[57] ABSTRACT

This invention is directed to a plumbing fixture to lessen and to prevent the flow of a liquid, from a source of liquid, flowing to an apparatus such as a washing machine or a dishwasher. More, particularly, this plumbing fixture is directed to lessening the flow of a liquid from a laundry tub to a washing machine or a dishwasher by a syphoning effect. The liquid in the laundry tub is not allowed to flow to the washing machine or a dishwasher by a syphoning action.

4 Claims, 10 Drawing Figures

PLUMBING FIXTURE

This patent application is a continuation-in-part of my copending patent application, Ser. No. 798,836, filing date of May 20, 1977 entitled A PLUMBING FIXTURE.

THE BACKGROUND OF THE INVENTION

In certain installations, it is necessary to preclude a machine or an apparatus from syphoning water back into the machine. For example, an automatic washing machine is connected to the hot and cold taps in a laundry tub. Also, the automatic washing machine has a discharge line which connects with the drain. Normally, the automatic washing machine is placed close to the laundry tub and the hot and cold taps. A pipe or tube runs from the laundry tub to the drain. With the automatic washing machine and the overflow for the laundry tub, both connecting with the drain, there is the possibility that the automatic washing machine may syphon some of the water in the laundry tub back into the washing machine. For example, many automatic washing machines have a suds-saver device whereby the discharge from the automatic washing machine can be introduced and stored in the laundry tub. Then, when it is desirable to wash a darker colored garment, the wash water in the laundry tub can be reintroduced into the automatic washing machine and used for washing the darker colored garment. For example, in the first wash there may be washed white clothes. The discharged water from washing the white clothes may be introduced into the laundry tub. After the white clothes have been washed, then light colored clothes and bath towels may be placed in the washing machine and the discharged water from the white clothes may be reintroduced into the washing machine for washing the light colored clothes and the bath towels. After the bath towels have been washed, the discharge water from this washing may be reintroduced into the laundry tub. Then, there may be washed dark color clothes, such as blue jeans and the like. The water in the laundry tub may be reintroduced into the washing machine for washing the dark color clothes. The result is a saving in hot water as the hot water from the washing machine can be reused and also there is some saving in washing agent or cleaning agent. Unfortunately, once in a while the washing machine, on a rinse cycle, may syphon off or suck into the washing machine some of the waste water from a previous washing. The introducing of the waste water into the washing machine with rinsed clothes may stain the clothes or may contaminate the clothes and get the clothes partially dirty. With this problem in mind, I have devised the subject invention.

THE GENERAL DESCRIPTION OF THE INVENTION

This invention comprises a plumbing fixture having a housing with a through passageway. The housing has a small end which can connect by means of a tube or pipe with the discharge of the automatic washing machine. Also, the housing has a large end which can connect with a pipe for connecting with the drain. Further, there is another pipe which can connect by means of a tube or pipe with the overflow drain in a laundry tub. The result is that the automatic washing machine cannot syphon from the laundry tub or suck from the laundry tub the waste water or the wash water in the laundry tub so as to contaminate the rinsed clothes in the automatic washing machine.

THE OBJECTS AND THE ADVANTAGES

An object of this invention is to provide a plumbing fixture which lessens the possibility of overflow from a laundry tub to flow into a washing machine; another object of this invention is to provide a plumbing fixture at a low cost; an additional object is to provide a unitary plumbing fixture prepared from a suitable plastic; a further important object is to provide such a plumbing fixture which is easy to install and has no threaded parts; another object is to provide such a plumbing fixture which is positive in its action in lessening the overflow from the laundry flowing into a washing machine; and, an additional object is to provide such a plumbing fixture which has low or no maintenance and once installed should prove to be satisfactory for the life of the laundry tub and the washing machine.

These and other important objects and advantages of the invention will be more, particularly, brought forth upon reference to the specific description of the invention, the appended claims and the accompanying drawings.

THE DRAWINGS

THE SPECIFIC DESCRIPTION OF THE INVENTION

Figure 1:
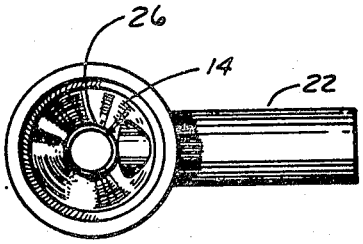
FIG. 1 is a view looking at the discharge end of a first species of the plumbing fixture.
Figure 2:
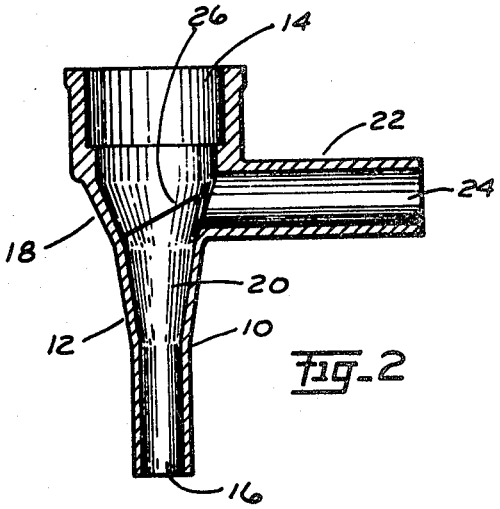
FIG. 2 is a longitudinal cross-sectional view looking at the interior of the plumbing fixture.
Figure 3:
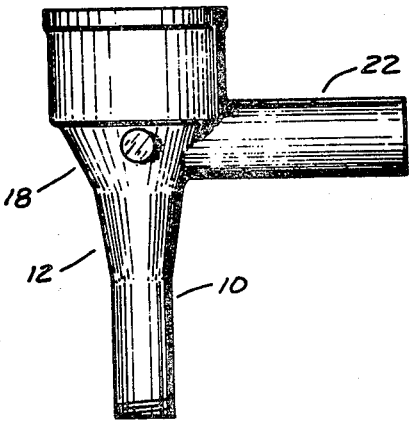
FIG. 3 is a side elevational view of the plumbing fixture.

The invention comprises a plumbing fixture 10 having a housing 12.

The plumbing fixture 10 has a large outflow end 14 and a small inlet end 16. There is a tapering body 18 between the large outflow end 14 and the small inlet end 16. Also, there is a through passageway 20 in the housing 12 running from the small inlet end 16 through the tapering body 18 and to the large outflow end 14.

Figure 4:
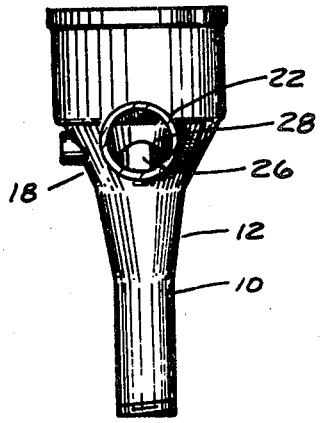
FIG. 4 is a side elevational view looking through the overflow tube of the plumbing fixture and into the interior passageway of the plumbing fixture and depicts the baffle in the plumbing fixture.
Figure 5:
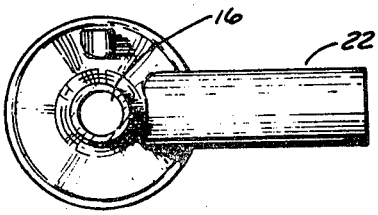
FIG. 5 is an end elevational view looking at the small inlet end of the plumbing fixture.
Figure 6:
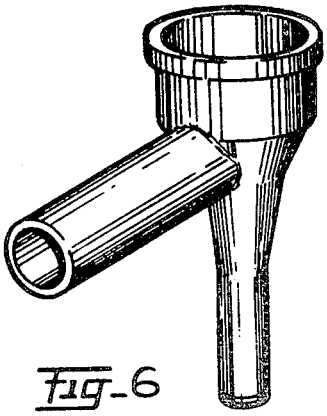
FIG. 6 is a perspective view looking at the plumbing fixture and illustrating the large outflow end, the small inlet end, and the overflow tube.

There is an overflow tube 22 connecting with the housing 12 between the large outflow end 14 and the small inlet end 16. The overflow tube 22 has a passageway 24 and which passageway connects with the through passageway 20. There is positioned in the housing 12 and in the through passageway 20 a baffle 26. This baffle is positioned near the connection of the passageway 24 in the overflow tube 22 with the through passageway 20. In FIG. 4, it is seen that the baffle 26 has a curved surface 28 near the connection of the passageway 24 in the overflow tube 22 with the through passageway 20. The baffle 26 disrupts and interferes with the flow of liquid through the overflow tube 24 into the passageway 20. The baffle 26 lessens the possibility of a liquid flowing in the passageway 24 and to the small outlet end 16. Instead, the baffle 26 assists in directing the flow of liquid in the passageway 24 to flow through the large outflow end 14, and prevents the flow of liquid in the passageway 24 to the small outlet end 16.

The plumbing fixture 10 is unitary and may be formed from a suitable plastic, such as ABS, acrylonitrile-butadiene-styrene plastic.

Figure 7:
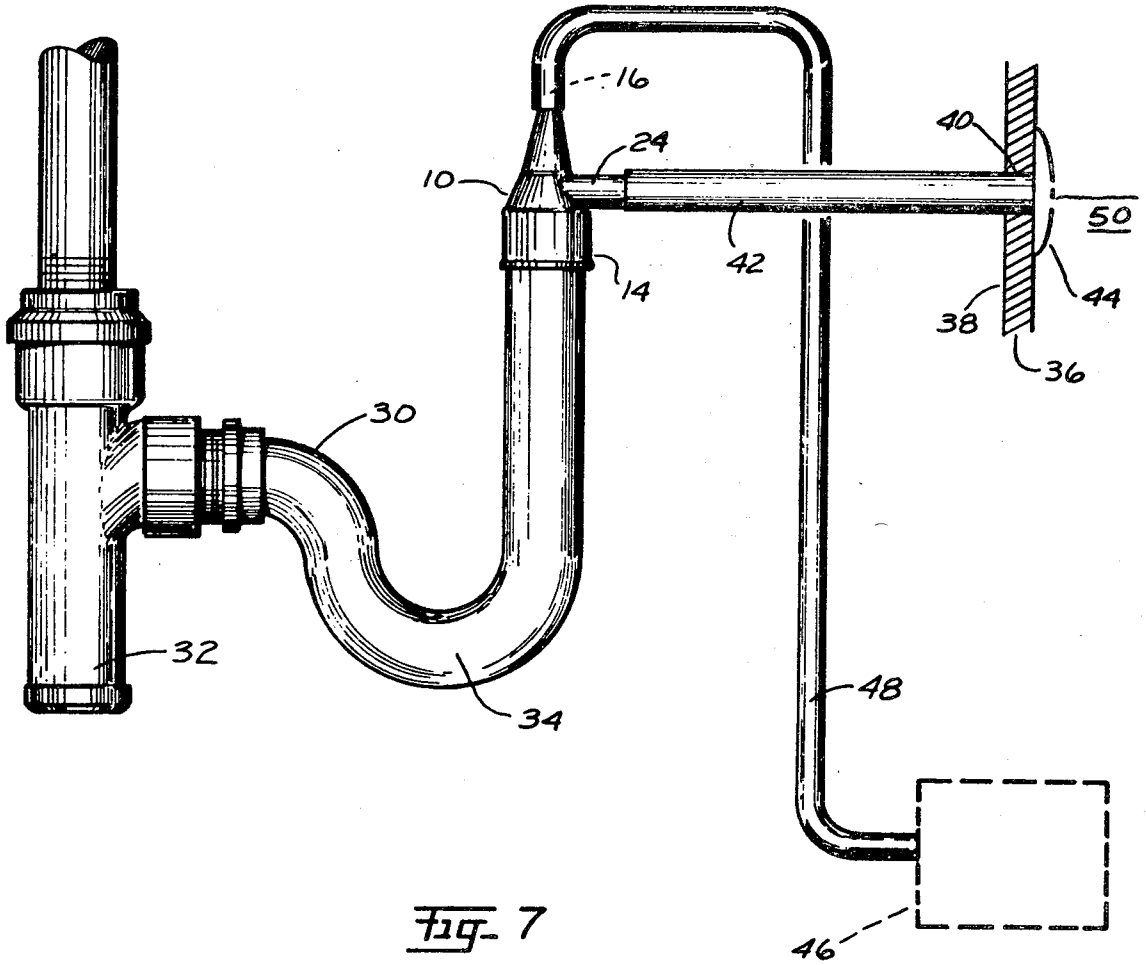
FIG. 7 is a view of a plumbing system comprising the unitary plumbing fixture, the wall of a laundry tub with the overflow tube connecting with the interior of the laundry tub, an appliance, such as an automatic washing machine, and a drain.

In FIG. 7, there is illustrated a plumbing system 30 comprising the plumbing fixture 10. It is seen that there is a drain pipe 32. There is a gooseneck 34 connecting with the drain pipe 32 and also with the large outflow end 14 of the plumbing fixture 10. There is a laundry tub 36 having a wall 38. In the wall 38 is a passageway 40. There is positioned in the passageway 40 an overflow pipe 42. On that end of the overflow pipe 42 inside the laundry tub 36, there is an adapter or strainer 44. The overflow pipe 42 connects with the overflow tube 24.

There is an appliance 46, such as an automatic washing machine or an automatic dishwasher. The discharge or outlet of the appliance 46 is a tube 48 which connects with the small inlet end 16 of the plumbing fixture 10.

In operation, when the appliance 46 discharges waste water, the waste water will flow through the plumbing fixture 10 and to the gooseneck 34 and out the drain 42. If there is sufficient water 50 in the laundry tub 36, then the water 50 will flow through the strainer 44, the pipe 42, and the overflow tube 24 to the plumbing fixture 10. If the pressure in the appliance 46 is less than the gooseneck 34 there is the possibility of the appliance 46 sucking some of the water 50 through the discharge tube 48 and into the appliance 46. The appliance 46 may decrease the pressure in the plumbing fixture 10 so that there is a tendency for the waste water of liquid flowing through the overflow tube 24 and into the plumbing fixture 10 to flow into the appliance 46. The baffle 26 interferes with the flow of the waste water 50 flowing through the overflow tube 24 and into the plumbing fixture 10. This interference by the baffle 26, with the flow of waste water through the overflow tube 24 into the plumbing fixture 10 lessens the possibility of the waste water 50 flowing into the through passageway 20, then through the small inlet end 16, through the discharge pipe 48 and into the appliance 46.

In other words, the baffle 26 in the plumbing fixture 10 functions as a preventer for the reverse flow of the waste water or liquid 50 into the appliance 46.

The appliance 46 may be an automatic washing machine or an automatic dishwasher. As stated, previously, quite often the first wash water from an automatic washing machine, is stored in the laundry tub 36 so as to save hot water and also some cleaning agent. With the rinse of the articles in the appliance 46 and a full tub of water 50 in the laundry tub 36, there may be a tendency for some of the water in the tube 36 to flow into the appliance 46 and soil the articles being cleaned in the appliance 46, such articles being clothes and eating utensils.

Figure 8:
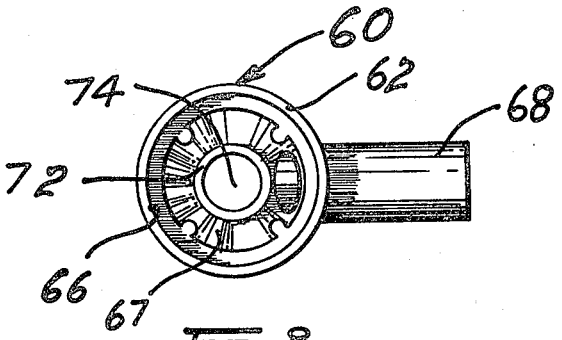
FIG. 8 is a view looking at the discharge end of a second species of the plumbing fixture.
Figure 9:
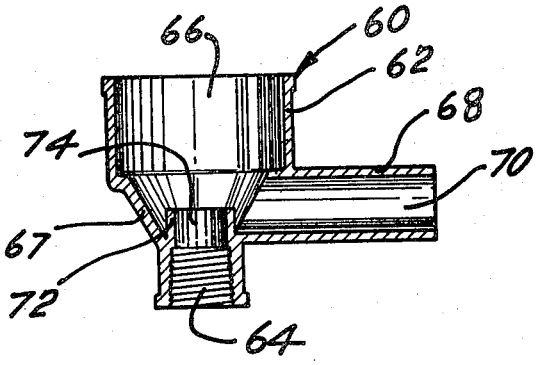
FIG. 9 is a longitudinal cross-sectional view looking at the interior of the plumbing fixture; and, FIG. 10 is a side-elevational view looking through the overflow tube of the plumbing fixture and into the interior passageway of the plumbing fixture and depicts the baffle in the plumbing fixture.
Figure 10:
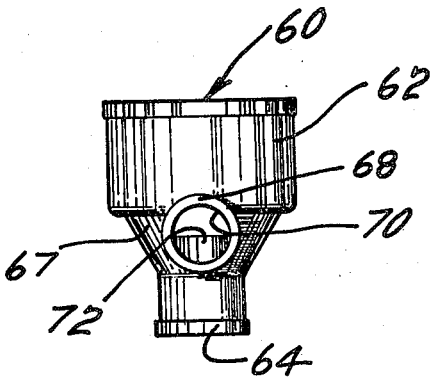

In FIGS. 8, 9 and 10 there is illustrated another species of a plumbing fixture. This species is identified by reference numeral 60.

In the drawings it is seen that there is a housing 62 having a small inlet end 64. The small inlet end 64 is in internally threaded. There is a large outlet end 66. Between the small inlet end 64 and the large outlet end 66 there is a cone member 67.

There is an overflow tube 68 which connects with the housing 62 between the small inlet end 64 and the large outlet end 66 and with the conical section 67. The overflow tube 68 has a passageway 70.

It is seen that the small inlet end 64, inside of the conical part 67, connects with or extends into a right circular tube or baffle 72 or right circular cylinder. The baffle 72 extends part way into the conical part 67 and blocks, partly, the passageway 70.

In the fixture 60 there is a through passageway 74 which can be defined as the passageway in the small inlet 64, the passageway in the baffle 72 and the passageway in the large outlet end 66.

The passageway 70 connects with the through passageway 74.

In combination with the overflow tank, the appliance and the drain line it is seen that the small inlet end 64 connects with the pipe 48 which connects with the appliance 46.

The large outlet end 66 connects with the gooseneck 34 which in turn connects with the drain 32.

The overflow tube 68 connects with the tube 42 which in turn connects with the drain fitting 44 in the tub 38.

In operation, if the pressure in the appliance 36 is less than the pressure in the drain line 32 there is a tendency for the liquid 50 to flow back through the line 48 into the appliance 46. With the liquid 50 flowing through the passageway 70 and the overflow tube 68 the liquid strikes the baffle 72 and is disbursed and scattered. By being disbursed and scattered the force of gravity pulls the liquid 50 downwardly through the large outlet end 66 and into the gooseneck 34. Even though the pressure in the appliance 46 may be less than the pressure in the drain line 32 the scattering of liquid 50 and the disbursing of the liquid 50 by the baffle 67 and the force of gravity on this disbursed liquid 50 allows the liquid to fall into the gooseneck 34 and then drain into the drain 32. The result is that the fixture 60 with the baffle 72 prevents the flow of the liquid 50 back into the appliance 46.

The baffle 72 may be considered to be a right circular cylinder.

The fixture 60 is of plastic such as ABS plastic. Also, since the fixture 60 is plastic the fixture 60 can be of unitary construction.

From the foregoing, it is seen that I have provided plumbing fixtures 10 and 60 in the form of a Tee which prevent liquid or water flowing into the appliance, such as an automatic washing machine or an automatic dishwasher, from an overflow discharge outlet in a tray or a tub. Further, it is seen that since the Tee is made of plastic and is of unitary construction that the cost of the Tee is inexpensive. Further, the plumbing fixture 10 is easy to install as there are no threaded parts but just slip joints. For example, the gooseneck 34 may slip into the larte outflow end 14. For example, the gooseneck 34 may be of ABS plastic. A person can wet the end of the gooseneck with acetone or other solvent and also coat the inside of the large outflow end 14 with acetone or other solvent and shove the two pieces together to form a tight joint. Likewise, the discharge pipe 48 can fit with the small inlet end 16. The small inlet end 16 of the plumbing fixture 10 and the discharge pipe 48 may be sealed together by means of acetone or other solvent. Further, the overflow tube 24 may be connected to the overflow pipe 42 by means of acetone or other suitable solvent.

The plumbing fixture 60 has an internally threaded small inlet end 64 for connecting with discharge tube 48 and a smooth internal large outlet end 66. The end 66 can be part of a slip joint as above described.

The plumbing fixture 10 is low cost and provided positive action in lessening the possibility of waste water flowing in the reverse direction through the discharge pipe 48 and into the appliance 46. Further, the plumbing fixture 10 requires little or no maintainance. As is well known, the plastic, ABS, used in the plumbing fixture 10 has a low coefficient of friction and therefore there is little tendency for lint and other objects in the waste water 14 to stick to the inside or adhere to the inside of the fixture 10.

Prior to preparing this patent application, a patent search was made. The following patents are of interest:

| U.S. Pat. No. | INVENTOR |
|---|---|
| 1,165,127 | C. S. C. Rock |
| 1,201,081 | G. A. Nilson |
| 2,045,479 | H. J. Luff |
| 2,691,986 | J. B. Kirby |
| 2,878,826 | S. Dolenga |
| 3,086,543 | J. E. McAuley |
| 3,346,887 | Sommer |
| 3,358,298 | P. J. Beyerle |
| 3,894,302 | Lasater |

From the foregoing and having presented my invention, what I claim is:

1. A plumbing system comprising a unitary plumbing fixture and plumbing apparatus:

a. said unitary plumbing fixture comprising a housing:

b. a large outflow end;

c. a small inlet end;

d. said housing defining a tapering body between said large outflow end and said small inlet end;

e. said housing defining a through passageway from said small inlet end, through said tapering body and to said large outflow end;

f. an overflow tube having a passageway connecting with said housing and with said through passageway;

g. said plumbing apparatus comprising a drain line connecting with said large outflow end;

h. a discharge line connecting with said small end and with an apparatus for discharging a liquid to said small inlet end:

i. an overflow line connecting with said overflow tube and with a source of liquid;

j. said unitary plumbing fixture lessening the possibility of a liquid from said source of liquid flowing to said apparatus for discharging a liquid to said small inlet end;

k. a baffle in said through passageway and juxtapositioned to the inner end of the passageway in said overflow tube to disrupt the flow of liquid from said overflow tube into said through passageway and to direct said liquid toward said large outflow end and away from said small inlet end; and, l. said baffle being a tube.

2. A plumbing system and a plumbing apparatus according to claim 1 and comprising:

a. said unitary plumbing fixture being of plastic.

3. A plumbing system and a plumbing apparatus according to claim 1 and comprising:

a. said baffle being in the configuration of a right circular cylinder.

4. A plumbing system and a plumbing apparatus according to claim 3 and comprising:

a. said unitary plumbing fixture having slip fittings on said large end and said overflow tube, and said small inlet end being threaded.

* * * * *